US006250980B1

(12) United States Patent
Ozawa

(10) Patent No.: US 6,250,980 B1
(45) Date of Patent: Jun. 26, 2001

(54) INJECTION SYSTEM FOR WATERCRAFT ENGINE

(75) Inventor: Shigeyuki Ozawa, Shizuoka (JP)

(73) Assignee: Yamaha Hatsudoki Kabushiki Kaisha, Shizuoka-ken (JP)

( * ) Notice: Subject to any disclaimer, the term of this patent is extended or adjusted under 35 U.S.C. 154(b) by 0 days.

(21) Appl. No.: 09/221,557

(22) Filed: Dec. 28, 1998

(30) Foreign Application Priority Data

Dec. 26, 1997 (JP) ..... 9-361048

(51) Int. Cl.[7] ..... B63H 21/10
(52) U.S. Cl. ..... 440/88; 114/55.5
(58) Field of Search ..... 440/111, 88, 89; 123/470; 114/55.1

(56) References Cited

U.S. PATENT DOCUMENTS 4,787,328 * 11/1988 Inoue ..... 114/55.51
4,982,682 * 1/1991 Hattori ..... 114/211
5,553,579 9/1996 Yoshida et al. .
5,632,660 5/1997 Nakase et al. .
5,762,040 * 1/1998 Taipale et al. ..... 123/299
5,902,158 5/1999 Nakase et al. .
5,906,524 5/1999 Ozawa et al. .
5,934,253 * 8/1999 Kojima et al. ..... 123/470

* cited by examiner

*Primary Examiner*—Ed Swinehart
(74) *Attorney, Agent, or Firm*—Knobbe, Martens, Olson & Bear, LLP

(57) ABSTRACT

An improved arrangement of a fuel injection system within a personal watercraft reduces the likelihood that certain sensitive components of the fuel injection system will contact water, regardless of the orientation in which the watercraft floats. Because of the sporty nature of personal watercraft, these boats often are inverted or laid on their sides. The fuel injectors of the fuel injection system are positioned within an engine compartment of the watercraft so as to remain above the water surface level with the watercraft in any orientation. In one mode, the fuel injectors also are positioned above the ends of air ducts through which air is introduced into the engine compartment. The fuel injectors are also shielded by protective covers. As a result, the occurrences of water contacting the fuel injectors is reduced.

39 Claims, 8 Drawing Sheets

INJECTION SYSTEM FOR WATERCRAFT ENGINE

BACKGROUND OF THE INVENTION

1. Field of the Invention

The present invention relates in general to an engine, and in particular to a component layout for a marine engine, including an arrangement of fuel injectors within the engine.

2. Description of the Related Art

Internal combustion engines are commonly used to power small watercraft such as personal watercraft. These watercraft include a hull which defines an engine compartment. The engine is positioned in the engine compartment. The output shaft of the engine is coupled to a water propulsion device to propel the watercraft.

Air must be supplied to the engine from outside the hull for use in the combustion process. Typically, air flows through one or more ducts in the hull into the engine compartment, and then through an intake system of the engine to the combustion chamber(s) of the engine.

Fuel also is supplied to the engine for use in the combustion process. In order to accurately meter the fuel, to improve engine operating efficiency and performance, and to better control emissions, many personal watercraft manufacturers are employing fuel injections system in which one or more fuel injectors inject fuel into the engine. In such systems, fuel is supplied to the fuel injectors at high pressure. Each injector has an electrically operated valve which selectively opens and closes, controlling the flow of fuel through the injectors to the engine.

Such systems, however, are not easily employed in a manner ensuring the system's durability on such watercrafts. Personal watercraft are sporting in nature; they turn swiftly, are easily maneuverable, and accelerate quickly. As a result of their sporting nature, they may at times become inverted or at least partially capsized While personal watercraft are designed to float under such conditions (and are easily righted), some water commonly enters the engine compartment under all conditions, even when upright through the air ducts. Such water can damage sensitive components of the fuel injection system, such as, for example, the fuel injectors. This problem is exacerbated should such components become submerged before the watercraft is righted.

SUMMARY OF THE INVENTION

A need therefore exists for a fuel injection system on a small watercraft, wherein the system's fuel injectors are arranged in engine compartment so that the fuel injectors, or at least the sensitive mechanical and electrical connections of the fuel injectors, remain above the water level regardless of the orientation of the watercraft. Such an arrangement reduces the likelihood that these connections will be submerged and become damaged.

One aspect of the present invention thus involves a watercraft comprising a hull defining an engine compartment. An internal combustion engine is positioned within the engine compartment and has an output shaft. A propulsion device is carried by the hull and is driven by the output shaft of the engine to propel the watercraft. A fuel supply system includes at least one fuel injector that communicates with the engine. A fuel delivery conduit is connected to the fuel injector to supply fuel thereto. A connection point between the fuel injector and the fuel delivery conduit is arranged within the engine compartment so as to be above the water surface level of the body of water in which the watercraft is operated when the hull floats in an upright position and when the hull floats in an inverted position. In one mode, a water-proof cover desirably encloses the connection point to shield the connection point from water that may slosh about within the engine compartment during use or when righting the watercraft.

Other sensitive components of the fuel injector can also be protected in a similar manner. For instance, an electrical connection point between an electrical connector of the fuel injector and an electrical cable, which controls the functioning of fuel injector, also is arranged in a similar position within the engine compartment. That is, this electrical connection point is arranged so as to be above the water surface level of the body of water in which the watercraft is operated when the hull floats in an upright position and when the hull floats in an inverted position.

In a preferred mode, these connection points are arranged within the engine compartment and on the engine, such that the connection points remain above the water level regardless of the orientation of the watercraft, i.e., upright, inverted, on its side or in an intermediate position.

Such sensitive components and contact points of the fuel injector also preferably lie at a position within the engine compartment that reduces the likelihood of contact with any water either present in or introduced into the engine compartment. For this purpose, the fuel injector, or at least its sensitive connection points, are arranged within the engine compartment above both an inlet to a bilge system and an outlet of an air duct that communicates with the engine compartment. In this manner, the occurrence of water contact with the fuel injector is lessened.

Further aspects, features, and advantages of the present invention will become apparent from the detailed description of the preferred embodiments which follow.

BRIEF DESCRIPTION OF THE DRAWINGS

The above-mentioned and other features of the invention will now be described with reference to the drawings of preferred embodiments of the present watercraft. The illustrated embodiments are intended to illustrate, but not to limit the invention. The drawings contain the following figures.

DETAILED DESCRIPTION OF PREFERRED EMBODIMENTS

Several embodiments of a fuel injection system and its layout within an engine compartment are disclosed for use with watercraft. Each of these embodiments employ the same basic concepts of inhibiting water contact with sensitive components of the fuel injection system and preventing submersion of such components regardless of the orientation of the watercraft (e.g., when inverted).

Figure 1:
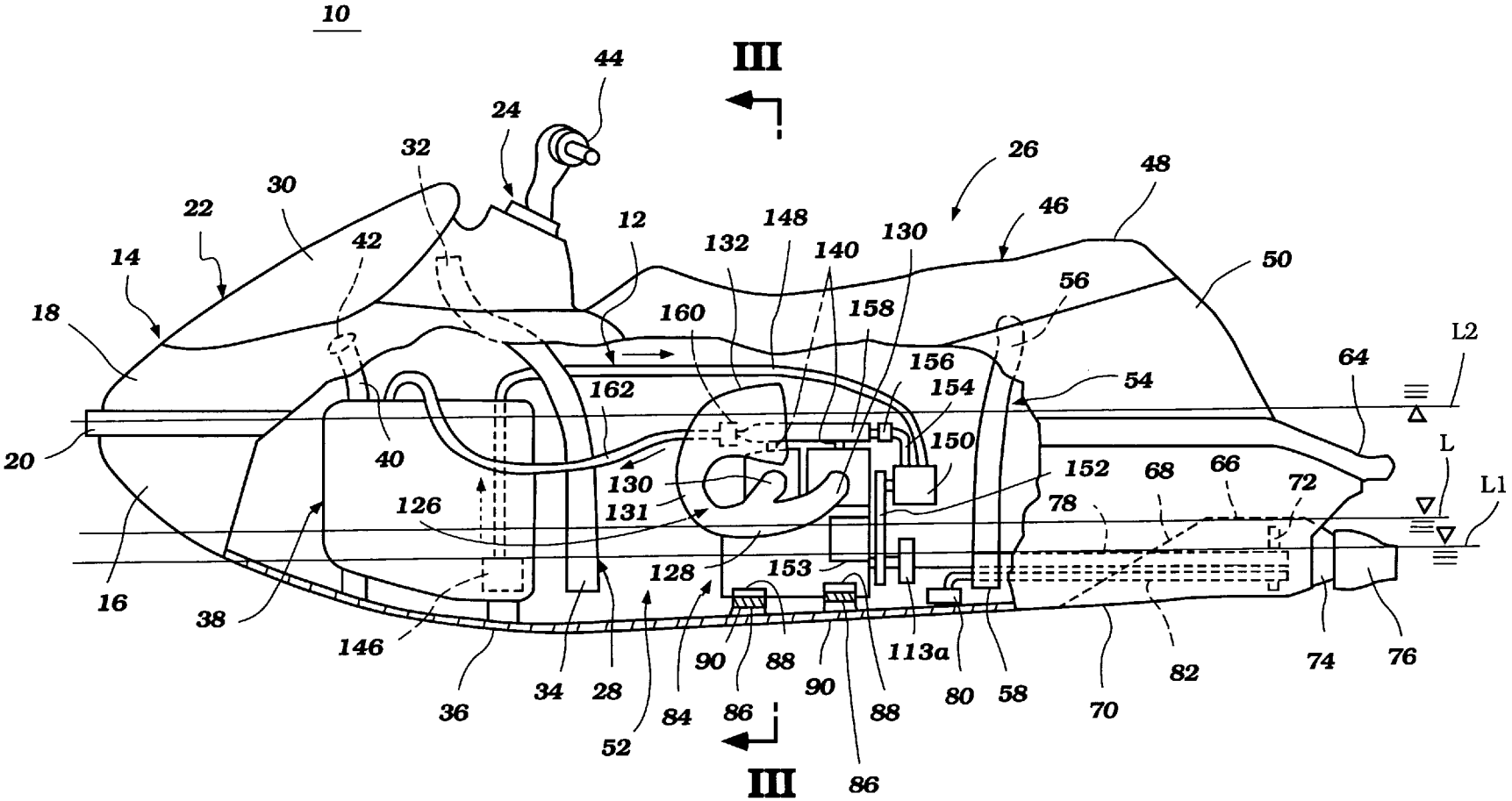
FIG. 1 is a partial sectional, side elevational view of a personal watercraft including a fuel injection system arranged within the watercraft in accordance with a preferred embodiment of the present invention.
Figure 2:
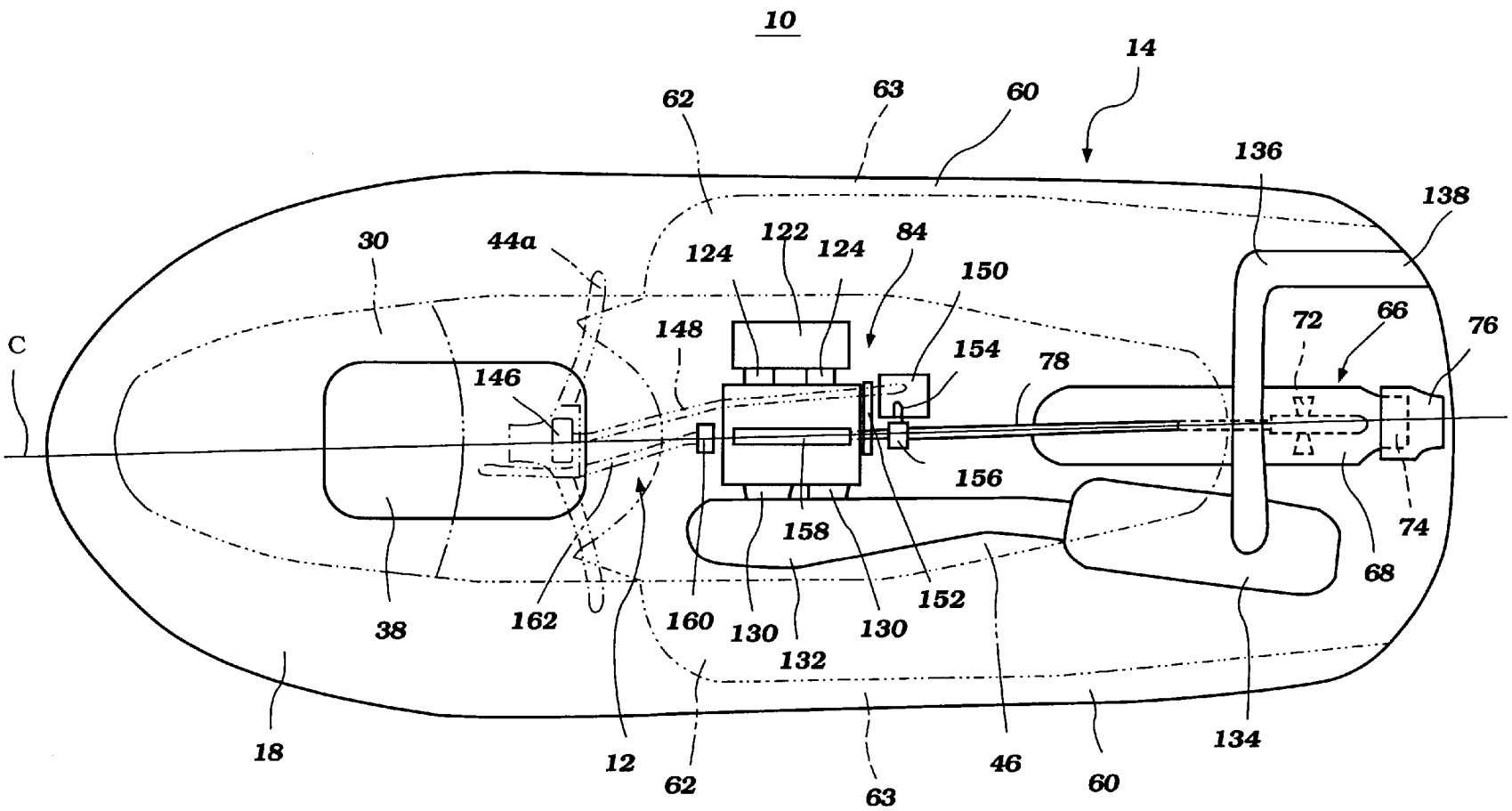
FIG. 2 is a top view of the fuel injection system and an engine of the watercraft of FIG. 1 with the body of the watercraft illustrated in phantom.

FIGS. 1 and 2 illustrate a personal watercraft 10 which includes a fuel supply system 12 configured and arranged within the watercraft 10 in accordance with a preferred embodiment of the present invention. Although the present fuel injection system 12 is illustrated in connection with a personal watercraft, various aspects of the present injection system can be used with other types of watercraft as well, such as, for example, but without limitation, small jet boats and the like. Before describing the fuel injections system 12 and its arrangement within an engine compartment of the watercraft, an exemplary personal watercraft 10 will first be described in general details to assist the reader's understanding of the environment of use and the operation of the fuel injection system 12.

With initial reference to FIGS. 1 and 2, the watercraft 10 includes a hull 14, formed by a lower hull section 16 and upper hull sections 18. The hull sections 16, 18 are formed of a suitable material such as, for example, a molded fiberglass reinforced resin or SMC. The lower hull section 16 and the upper deck section 18 are fixed together around the peripheral edges or gunnels 20 in any suitable manner.

As viewed in a direction from bow to stern of the watercraft 10, the upper deck section 18 includes the bow portion 22, a control mast portion 24, and a rider's area 26. The bow portion 22 slopes upwardly towards the control mast 24 and includes at least one air duct 28 through which air enters the hull 14. A hatch cover 30 desirably extends above an upper inlet 32 of the air duct 28 to inhibit an influx of water into the bull 14. As seen in FIG. 1, the air duct 28 terminates at a lower end opening 34 located near a lower surface 36 of the lower hull section 16.

A fuel tank 38 is located within the hull 14 beneath the hatch cover 30. Conventional means, such as, for example, straps, secure the fuel tank 38 to the lower hull 16. A fuel filler hose 40 extends between a fuel filler cap assembly 42 and the fuel tank 38. In the illustrated embodiment, the fuel cap assembly 42 is arranged on the bow portion 22 of the hull upper deck 18, to the side and in front of the control mast 24. In this manner, the fuel tank 38 can be filled from outside the hull 14 with the fuel passing through the fuel filler hose 40 into the fuel tank 38.

The control mast 24 extends from the bow portion 22 and supports a handlebar assembly 44. The handlebar assembly 44 controls the steering of the watercraft 10 in a conventional manner. The handlebar assembly also carries a variety of controls of the watercraft 10, such as, for example, a throttle control, a start switch, and a lanyard switch.

The rider's area 26 lies behind the control mast 24 and includes a seat assembly 46. In the illustrated embodiment, the seat assembly 46 has a longitudinally extending straddle-type shape that can be straddled by an operator and by at least one, two, or three passengers. The seat assembly 46 is, at least in principal part, formed by a seat cushion 48 supported by a raised pedestal 50. The raised pedestal has an elongated shape and extends longitudinally along the center of the watercraft 10. The seat cushion 48 desirably is removably attached to the top surface of the pedestal 50 and covers the entire upper end of the pedestal 50 for the rider and passenger's comfort.

In the illustrated embodiment, the seat cushion 48 has a single-piece construction and covers the entire upper surface of the pedestal 50. The seat cushion 48, however, can be formed in sectional pieces which are individually attached to the seat pedestal 50. In this manner, one sectional piece of the seat cushion 48 can be removed to expose a portion of the watercraft beneath the seat 48, without requiring removal of the other sectional piece(s). For instance, a rear sectional piece of the seat cushion 48 can be removed to gain access to a storage compartment located beneath the seat without requiring removal of a front sectional piece of the seat cushion 48.

An access opening is located on an upper surface of the pedestal 50. The access opening opens into an engine compartment 52 formed within the hull 14. The seat cushion 48 normally covers and seals closed the access opening. When the seat cushion 48 is removed, the engine compartment 52 is accessible through the access opening.

The pedestal 50 also desirably includes at least one air duct 54 located behind the access opening. The air duct 54 communicates with the atmosphere through an upper end port 56 located with a space between the pedestal 50 and the seat cushion 48 occurring behind the access opening. The rear air duct 54 terminates in a lower end opening 58 near the lower wall 36 of the lower hull portion 16 and at the aft end of the engine compartment 52. Air can pass through the rear duct 54 in both directions.

As best seen in FIG. 2, a bulwark 60 extends outwardly along each side of the watercraft 10. A foot well 62 is defined between the side of the pedestal 50 and the corresponding bulwark 60. In the illustrated embodiment, the foot wells 62 extend entirely along the length of the seat assembly 48 and open into a rear deck 64 (FIG. 1) that is located at the aft end of the watercraft above the transom. The foot wells, however, can be closed at their aft end with a suitable drainage system provided.

Floatation elements 63 are positioned within the hull 14 such that the watercraft 10 has sufficient buoyancy to float in a body of water in which the watercraft 10 is operated, within its bilge. In contrast, Line L1 represents the water surface level relative to the watercraft 10 when the watercraft 10 is at rest, but with no one is on the watercraft and no water is present within the hull. And as represented by Line L2, the watercraft 10 remains afloat, with a portion of the watercraft remaining above the water surface level L2, when the watercraft 10 is inverted. The same hold true when the watercraft 10 is turned on its sides or resides in an intermediate position, as represented by lines L3–L6: Line L3 represents the water surface level relative to the watercraft 10 with the watercraft 10 leaned on its port side from an upright position; Line L4 represents the water surface level relative to the watercraft 10 with the watercraft 10 leaned on its starboard side from an upright position; Line L5 represents the water surface level relative to the watercraft 10 with the watercraft 10 leaned on its port side from an inverted position; and Line L6 represents the water surface level relative to the watercraft 10 with the watercraft leaned on its starboard side from an inverted position.

The size and arrangement of the floatation elements 63 are selected so as to produce a space within the engine compartment 52 that remains above the water surface 60 of the hull 14. Floatation elements 63 can also be located at the bow 22 of the watercraft 10, about the fuel tank 38, and at the aft end of the hull 14.

The lower hull 16 is designed such that the watercraft 10 planes or rides at a minimum surface area at the aft end of the lower hull 16 in order to optimize the speed and handling of the watercraft 10 when up on plane. For this purpose, the lower hull section 16 generally has a V-shaped configuration formed by a pair of inclined sections that extend outwardly from a keel of the hull to the hull's side walls at a dead rise angle. The incline sections also extend longitudinally from the bow towards the transom of the lower hull 14. The side walls are generally flat and straight near the stern of the hull and smoothly blend towards the longitudinal center C FIG. 2) of the watercraft at the bow. The lines of intersection between the incline section and the corresponding side walls form the outer chines of the lower hull section 16.

Toward the transom of the watercraft, the inclined sections of the lower hull 16 extend outwardly from a recessed channel or tunnel that extends upwardly toward the upper deck portion 18. The tunnel generally has a parallelepiped shape and opens through the transom of the watercraft 10.

In the illustrated embodiment, a jet pump unit 66 is mounted within the tunnel formed on the underside of the lower hull section 16. An intake duct 68 of the jet pump unit 66 defines an inlet opening 70 that opens into a gullet of the intake duct 68. The intake duct 68 leads to an impeller housing assembly in which an impeller 72 of the jet pump unit 66 operates. The impeller housing assembly also acts as a pressurization chamber and delivers the water flow from the impeller housing to a discharge nozzle 74. A steering nozzle 76 is supported at a downstream end of the discharge nozzle 74 by a pair of vertically extending pivot pins. In an exemplary embodiment, the steering nozzle 76 has an integral lever on one side that is coupled to the handlebar assembly 44 through, for example, a bowden-wire actuator, as known in the art. In this manner, the operator of the watercraft can move the steering nozzle 76 to effect directional changes of the watercraft 10.

A ride plate covers a portion of the tunnel behind the inlet opening 70 to close the jet pump unit 66 within the tunnel. In this manner, the lower opening of the tunnel is closed to provide a plane surface for the watercraft 10.

An impeller shaft 78 supports the impeller 72 within the impeller housing of the jet pump unit 66. The aft end of the impeller shaft 78 is suitably supported and journalled within the compression chamber of the jet pump unit 66 in a known manner. The impeller shaft 78 extends forwardly through a front wall of the tunnel and/or through a bulkhead formed within the hull 14.

Figure 3:
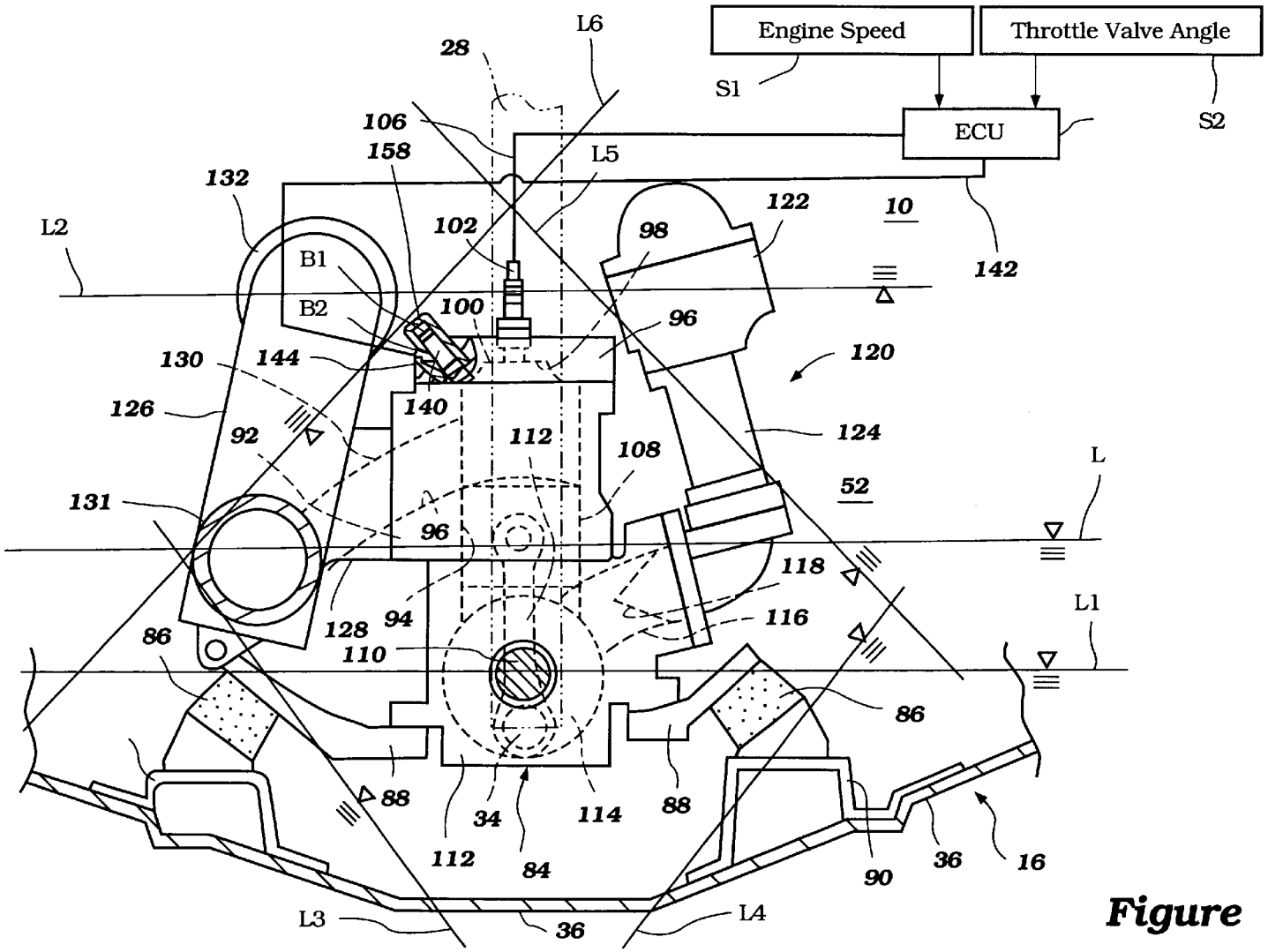
FIG. 3 is a cross-sectional view of the watercraft of FIG. 1 taken along line III—III.

As seen in FIG. 1, the watercraft 10 includes a bilge system to remove water from the engine compartment 52 which commonly enters through the air ducts 28, 54. The bilge system includes a water pickup 80 located on the lower surface 36 and at the aft end of the engine compartment 52 near the lower end opening 58 of the rear duct 54. In the illustrated embodiment, the bilge system employs a Venturi-type pump by utilizing the reduced pressure formed within the jet pump unit 66. For this purpose, a bilge hose 82 connects the water pickup 80 to the jet pump unit 66. The bilge system can alternatively include a mechanical bilge pump driven by an electric motor. Internal combustion engine 84 of the watercraft 10 powers the propulsion shaft 78 to drive the impeller 72 of the jet pump unit 66. As seen in FIGS. 1 and 2, the engine 84 is positioned within the engine compartment 52 and is mounted behind the control mast 24, beneath the seat assembly 46. In the illustrated embodiment, the engine 84 is arranged within the engine compartment 52 at a longitudinal position that is generally beneath the access opening formed on the upper surface of the seat pedestal 50. In the illustrated embodiment, the engine 84 includes two in-line cylinders and operates on a two-stroke, crankcase compression principle. The engine 84 is positioned such that the row of cylinders is generally parallel to a longitudinal axis of C of the watercraft 10, running bow to stern. The axis of each cylinder is generally parallel relative to a vertical central plane of the watercraft, in which the longitudinal axis C lies. This engine type, however, is merely exemplary. Those skilled in the art will really appreciate that the present fuel injection system 12 can be used with a variety of engine types having other number of cylinders, having other cylinder arrangements (e.g., inclined) and operating on other combustion principles (e.g., four-stroke principle). With reference to FIGS. 1 and 3, vibration absorbing engine mounts 86 secure the engine 84 to the lower surface 36 of the lower hull portion 16. As best seen in FIG. 3, the engine mounts 86 are attached to the engine 84 by a first set of brackets 88 and to the lower surface 36 of the lower hull portion 16 by a second set of brackets 90. These lower brackets 90 are arranged to support the engine 84 at a distance above the lower wall 36, and at a desired location within the engine compartment, as described below.

As best seen in FIG. 3, a cylinder block 92 defines a plurality of cylinder bores 94. A plurality of scavenge passages are also formed within the cylinder block 92 and communicates with an upper portion of each cylinder bore 94 in a conventional manner. An exhaust port and passage 96 are also formed within the cylinder block for each cylinder bore 94 to also communicate with the upper portion of the corresponding cylinder bore 94. The cylinder block 92 thus defines scavenge passages and an exhaust passage for each cylinder bore 94.

A cylinder head 96 closes the top of each cylinder bore 94 and attaches to the cylinder block 92. The cylinder head 96 defines a recess 98 that cooperates with the cylinder bore 94 to form a combustion chamber 100. In the illustrated embodiment, a separate cylinder head 96 covers each cylinder bore 94; however, a unitary cylinder head with multiple recess 98 can also be used.

A spark plug 102 is mounted atop each recess 98 of the cylinder head 96 and has its gap extending into the combustion chamber 100. The spark plug 102 is fired by an ignition control circuit (not shown) that is controlled by an electronic control unit (ECU) 104. An ignition cable 106 couples the spark plug 102 to the ignition system controlled by the ECU 104.

As seen in FIG. 3, a piston 108 reciprocates within each cylinder bore 94 of the engine 84 and together the pistons 108 drive a crankshaft 110, which in the illustrated embodiment also functions as an output shaft for the engine 84. A connecting rod 112 links the corresponding piston 108 to the crankshaft 110. The corresponding cylinder bore 94, piston 108 and cylinder head recess 98 form a variable volume chamber, which at a minimum volume defines the combustion chamber 100.

The crankshaft 110 is journalled within a crankcase, which in the illustrated embodiment, is formed between a crankcase member 112 and a lower end of the cylinder block 92. The crankshaft extends beyond an aft end of the crankcase member and is coupled to the impeller shaft 78 by a coupling 113.

Individual crankcase chambers 114 of the engine 84 are formed within the crankcase by dividing walls and sealing disks. The crankcase chambers 114 sealed from one another, with each crankcase chamber 114 communicating with a dedicated variable volume chamber.

Each crankcase chamber 114 also communicates with an intake passage 116 formed within the crankcase member 112. A reed valve 118 is positioned at the inlet of the intake passage 116. The reed valve 118 permits air flow into the crankcase chamber 114 when the corresponding piston 108 moves towards top dead center (TDC), but precludes reverse flow when the piston 108 moves toward bottom dead center (BDC) to compress the air charge delivered to the crankcase chamber 114. The reed-type valve 118 is mounted on a support plate connected to the crankcase member 112.

Each crankcase chamber 114 also communicates with an induction system 120 through the reed-type valve 118 and the intake passage 116. In the illustrated embodiment, the induction system extends outward along the side of the cylinder block 92 so as to minimize the width of the engine 84. The induction system includes one or more air intake boxes 122 which define a plenum chamber to silence air drawn into the box before being drawn into the engine. The induction system 120 also includes a plurality of throttle devices 124 which communicate with the intake box 122. In the illustrated embodiment, the induction system 120 includes a dedicated throttle device 124 for each crankcase chamber 114 of the engine 84; however, a common throttle device can also be used.

Figure 8:
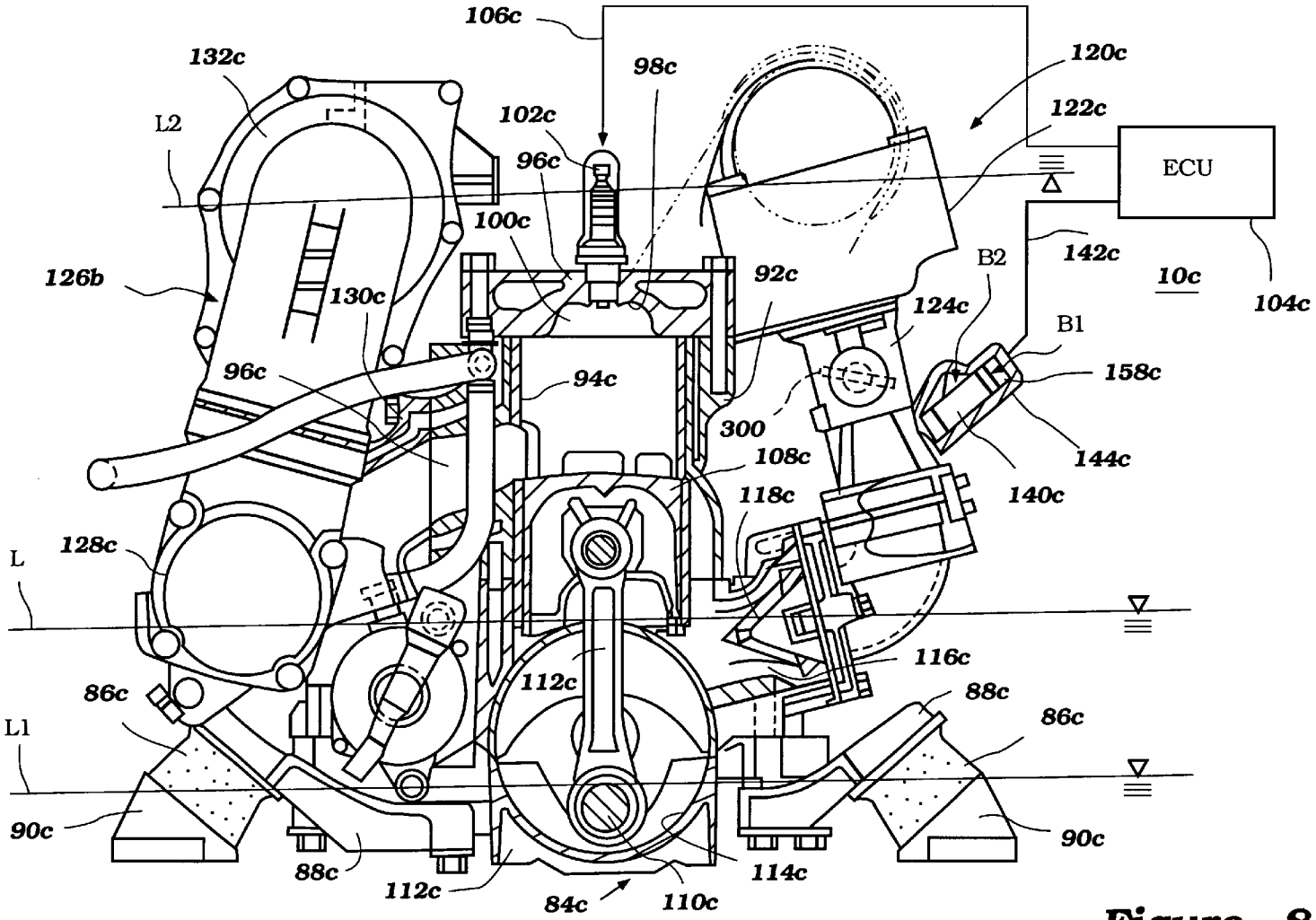
FIG. 8 is a cross-sectional view of an engine and associated fuel supply system for a personal watercraft configured in accordance with another preferred embodiment.

Each throttle device 124 includes a throttle body in which a throttle valve is supported (as illustrated in FIG. 8). In the illustrated embodiment, the throttle valve is supported by a throttle shaft which rotates the valve to vary the opening degree of the throttle valve within the throttle body and regulate the amount of air drawn into the engine 84, as known in the art. A suitable throttle actuation mechanism is employed with the engine 84 and is coupled to a throttle control device (e.g., throttle lever) located on the handlebar assembly 44.

An exhaust system 126 is located on the other side of the cylinder block 92 and is arranged to discharge exhaust by-products from the engine 84 to the atmosphere and/or to the body of water in which the watercraft is operated.

As seen in FIGS. 1–3, the exhaust system 126 includes an exhaust manifold 128 that is affixed to the side of the cylinder block 92. The exhaust manifold 128 includes a plurality of runner 130. Each runner 130 communicates with one of the exhaust passages 96 in the cylinder block 92. These runners merge together at an outlet end of the exhaust manifold 128.

The outlet end of the exhaust manifold 128 communicates with an expansion chamber 132. In the illustrated embodiment, the expansion chamber 132 is located along an upper portion of the engine 84 and extends generally in a longitudinal direction parallel to the longitudinal axis C. The orientation and position of the expansion chamber 132 within the engine compartment, however, can be varied such that the expansion chamber 132 extends along a lower portion of the engine 84 or along a side of the engine 84 that is opposite of the exhaust passage 96. With the exhaust passage 132 positioned along the upper side of the engine 84, a C-shaped header pipe 131 connects the exhaust manifold 128 to the expansion chamber 132. Although not illustrated, a flexible coupling desirably joins the header pipe 131 to the expansion chamber 132, as well known in the art.

The expansion chamber 131 has an enlarged passage relative to the manifold 128 and the header pipe 131 through which exhaust gases pass, for silencing of the exhaust gases. The expansion chamber 132 also includes a reduction cone at its aft end so as to produce a desired pressure wave within the exhaust system 126, as well known in the art.

As seen in FIG. 2, the outlet end of the expansion chamber 132 is connected to a flexible pipe which links the expansion chamber to water trap 134. In the illustrated embodiment, the water trap 134 lies on the same side of the longitudinal axis C of the watercraft 10 as does the expansion chamber 132; however, these components 132, 134 of the exhaust system 126 can lie on opposite sides of the longitudinal centerline C. The water trap 134 has a sufficient volume to retain water and to preclude the backflow of water to the expansion chamber 132 and the engine 84. Internal baffles within the water trap 134 help control waterflow through the exhaust system 126.

An exhaust discharge pipe 136 extends from an outlet end of the water trap 134 and wraps over the top of the tunnel to a discharge end 138. The discharge end 138 desirably opens either into the tunnel or through the transom of the watercraft 10 at an area that is close to or actually below the water level with the watercraft 10 floating at rest on the body of water.

The engine 84 also desirably includes an open-loop cooling system in which the jet pump unit 66 provides a supply of water to cooling jackets within the engine cylinder block 92, cylinder head 96, exhaust manifold 128, and expansion chamber 132. At least a portion of the cooling water passing through these cooling jackets is discharged into the exhaust stream at a point downstream of the expansion chamber 132 to silence and cool the exhaust gases before expulsion, as known in the art.

The fuel injection system 12 supplies fuel to the engine 84. In the illustrated embodiment, the fuel injection system 12 employs a direct injection principle. For this purpose, fuel injectors 140 are arranged so as to inject fuel directly into the combustion chamber 100 of each cylinder 94. As best seen in FIG. 3, each fuel injector 140 is mounted onto the cylinder head 96 with its nozzle located to spray fuel into the combustion chamber 100.

Each fuel injector 140 includes an electrically operated valve (e.g., a solenoid valve) that opens to spray a finite amount of fuel into the combustion chamber 100. The fuel injector 140 includes an electrical connector which is connected to a coil of the valve. The valve operates between an inlet port and a spray nozzle. The spray nozzle is positioned adjacent the combustion chamber 100 with the inlet port positioned on the exterior of the cylinder head 96.

An electrical control cable 142 is connected to the electrical connector at a connection point B2, as schematically represented in FIG. 3. A waterproof cover 144 encloses the exposed end of each fuel injector 140, including the corresponding connection point B2.

The ECU 100 controls the operation of the fuel injector valve. The ECU 104 receives information from a sensory system that monitors various operating parameters of the engine 84. For instance, the ECU 104 receives input signals from an engine speed sensor S1, which are indicative of the engine speeds, as well as receives input signals from a throttle valve angle sensor S2, which are indicative of the throttle valve positions. The ECU 104 processes this information to determine the operating condition of the engine and then to adjust the injection timing and amount (i.e., injection duration) to precisely control the air/fuel ratio of the charge formed within the combustion chamber 100 prior to ignition.

The balance of the fuel injection system 12 provides a continuous supply of fuel to the fuel injectors 140 from the fuel tank 38. In the illustrated embodiment, a low pressure fuel pump 146 is positioned within the fuel tank 78 and supplies a fuel delivery line 148 with fuel from the fuel tank 38. The low pressure fuel pump 146 includes a fuel pick-up located near the bottom of the fuel tank 38. The low pressure fuel pump 146 also can be of the submergible type and be electrically powered; however, other sources of power, such as a drive arrangement off the engine crankshaft 110 or pressure fluctuations obtained from one or more of the crankcase chambers 114 (e.g., for use with a diaphragm pump), can be used to pump fuel from the fuel tank 38 through the fuel delivery line 148.

The fuel delivery line 148 connects to a high pressure fuel pump 150. In the illustrated embodiment, the high pressure fuel pump 150 is driven by the crankshaft 110 by drive mechanism 152. The drive mechanism 152 can include a drive belt which operates between a drive pulley connected to the crankshaft 110 and a driven pulley connected to the high pressure fuel pump 150. Other drive mechanisms, however, can also be used such as, for example, a gear-type system In addition, the high pressure fuel pump can rather be driven by an auxiliary motor, such as, for example, an electric motor.

As best seen in FIG. 1, the drive mechanism 152 also drives a generator (e.g., an alternator) 153. The generator 153 can be used to directly power the low pressure fuel pump 146 and/or the high-pressure fuel pump 150, or can be used to charge a battery which drives the motor(s) of one or more of these pumps.

An intermediate fuel line 154 delivers the pressurized fuel from the high pressure fuel pump 150 to a fuel filter 156. The fuel filter 156 desirably is located at a location beneath the access opening so as to be easily accessible for maintenance and replacement. In the illustrated embodiment, the fuel filter 156, as well as the high pressure fuel pump, lie on the aft end of the engine 84; however, these components can alternatively be positioned on the front end.

A fuel rail 158 extends above the cylinder heads 96 and is arranged such that its axis is generally parallel to the longitudinal axis C. The fuel rail 158 is connected to each of the fuel injectors 140. In particular, the inlet port of each fuel injector 140 is connected to the fuel rail 158 at a connection point B1 such that pressurized fuel within the fuel rail 158 immediately flows into the fuel injector through the inlet port when the injector valve is opened. Each connection point B1 is also covered by the corresponding protective covering 144. In this manner, water sprayed or splashed about within the engine compartment 52 does not contact the connection point B1 between the fuel rail and the corresponding fuel injector 140, as well as the connection point B2 between the corresponding control cable 142 and the fuel injector electrical connector.

The fuel injection system 12 includes a pressure regulator 160 to control the pressure within the fuel rail 158, and thus, the pressure of the fuel at the inlet ports of the injectors 140. By adjusting the pressure regulator 160, the volume of fuel injected can be more particularly controlled. A return fuel line 162 connects the pressure regulator 160 to the fuel tank 38. In this manner, excess fuel is returned from the fuel rail 158 to the fuel tank 38.

As best understood from FIG. 3, the fuel injectors 140 and the fuel rail 158 are positioned so as to arrange the sensitive portions of these components at a location within the engine compartment 52 that prevents the components from being submerged when the watercraft 10 floats upright as well as when the watercraft is inverted. As noted above, Line L represents the water surface level relative to the watercraft 10 with passengers seated on the watercraft and water present in the engine compartment 52. Line L1 represents the surface level of the body of water with no passengers on the watercraft and no water present in the engine compartment 52. As schematically illustrated in FIG. 3, the fuel rail 158 and fuel injectors 140 lie well above the water surface level L1, and more preferably above the water surface level L when under the first condition. In addition, as schematically illustrated in FIG. 3, the position of these components 158, 140 also would lie above the water surface level L2 when the watercraft is inverted.

As illustrated in the present embodiment, it is also desirable to have the fuel rail 158 and fuel injectors 140 in a non-submerged position when the watercraft is lying either on its side, in an intermediate position between an upright position and lying on its side, or in an intermediate position between an inverted position and lying on its side. For instance, Lines L3 and L4 represent the position of the water surface level when the watercraft 10 is leaned on its port or starboard sides. Lines L5 and L6 represent the water surface level when the watercraft is inverted and leans on its port or starboard sides. As FIG. 3 schematically illustrates, the fuel rail 158 and the fuel injectors 140 remain above the water surface level under all of these conditions. And more importantly, the connection points B1 and B2 remain above the water surface level regardless of the orientation in which the watercraft 10 floats. As a result, this arrangement of the fuel rail 158 and fuel injectors 140 within the engine compartment 52 enhances the protection of these components.

The position of the fuel rail 158 and fuel injectors 140 is controlled not only by their position on the engine 84, but also by the relative position of the engine 84 within the engine compartment 82. The brackets 90, which support the engine mounts 88, can be sized and configured so as to position the fuel rail 158 and the fuel injectors 140 in a desired position within the engine compartment 52. In addition, the relative position of the water surface level under each floatation condition can be varied by adjusting the size and position of the floatation devices within the watercraft 10 so as to produce a region within the engine compartment 52 that remains above the water surface level under all floatation conditions.

The fuel injectors 140 and the fuel rail 158 also lie at a position relative to the inlet of the bilge system and an outlet of the air supply system that reduces the likelihood of water making contact with these components. For this purpose, as illustrated in FIGS. 1 and 3, the fuel injectors 140 and the fuel rail 158 are positioned within the engine preferably above the lower end 58 of the rear air duct 54. The fuel injectors 140 and the fuel rail 158 are also positioned above the water pick-up 80 for the bilge system. In this position, the occurrences of water splashing, spraying or sloshing onto the fuel rail 158 and the fuel injectors 140 is lessened.

Figure 4:
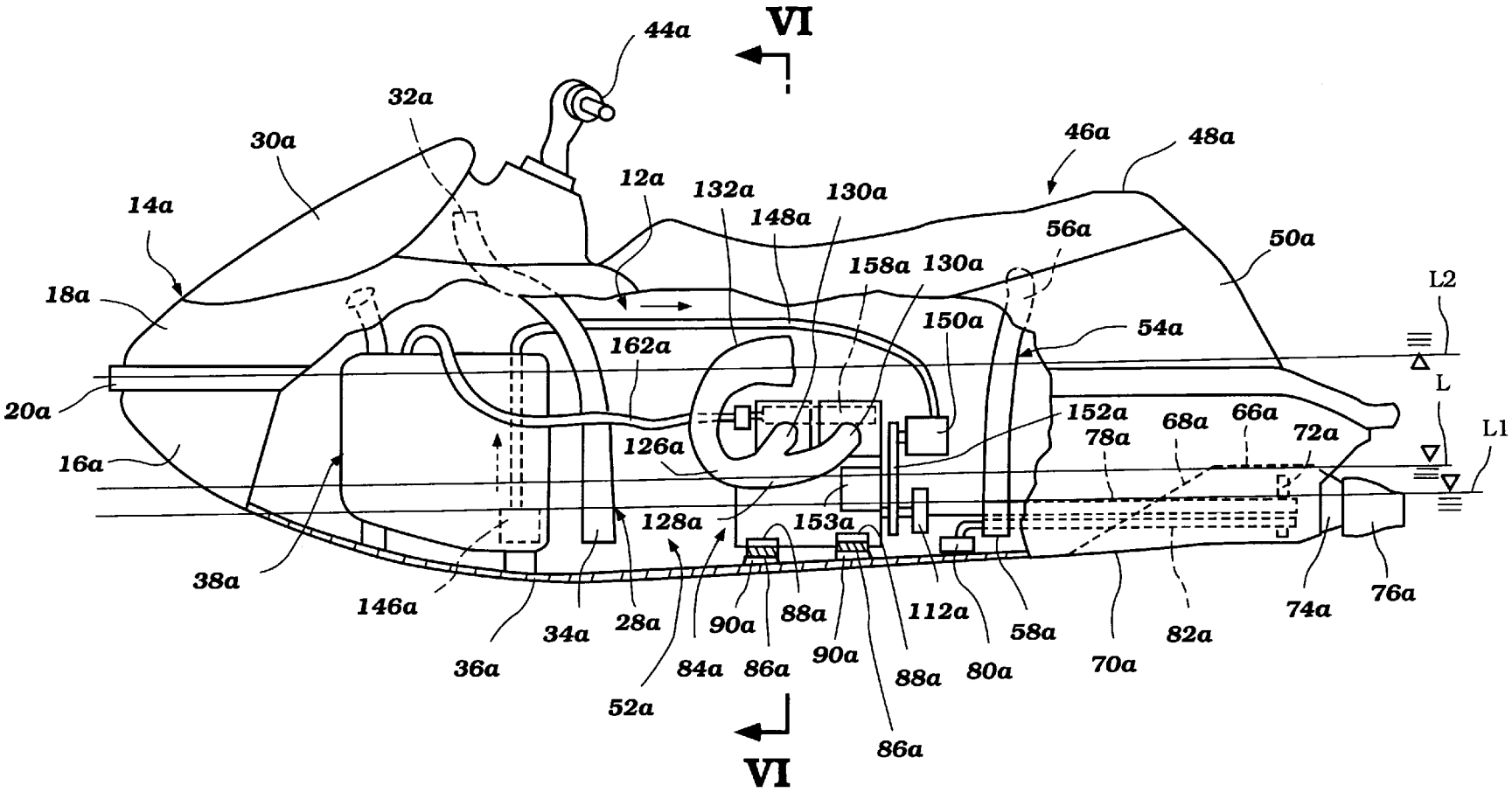
FIG. 4 is a partial sectional, side elevational view of a personal watercraft including a fuel injection system arranged within the watercraft in accordance with another preferred embodiment of the present invention.
Figure 5:
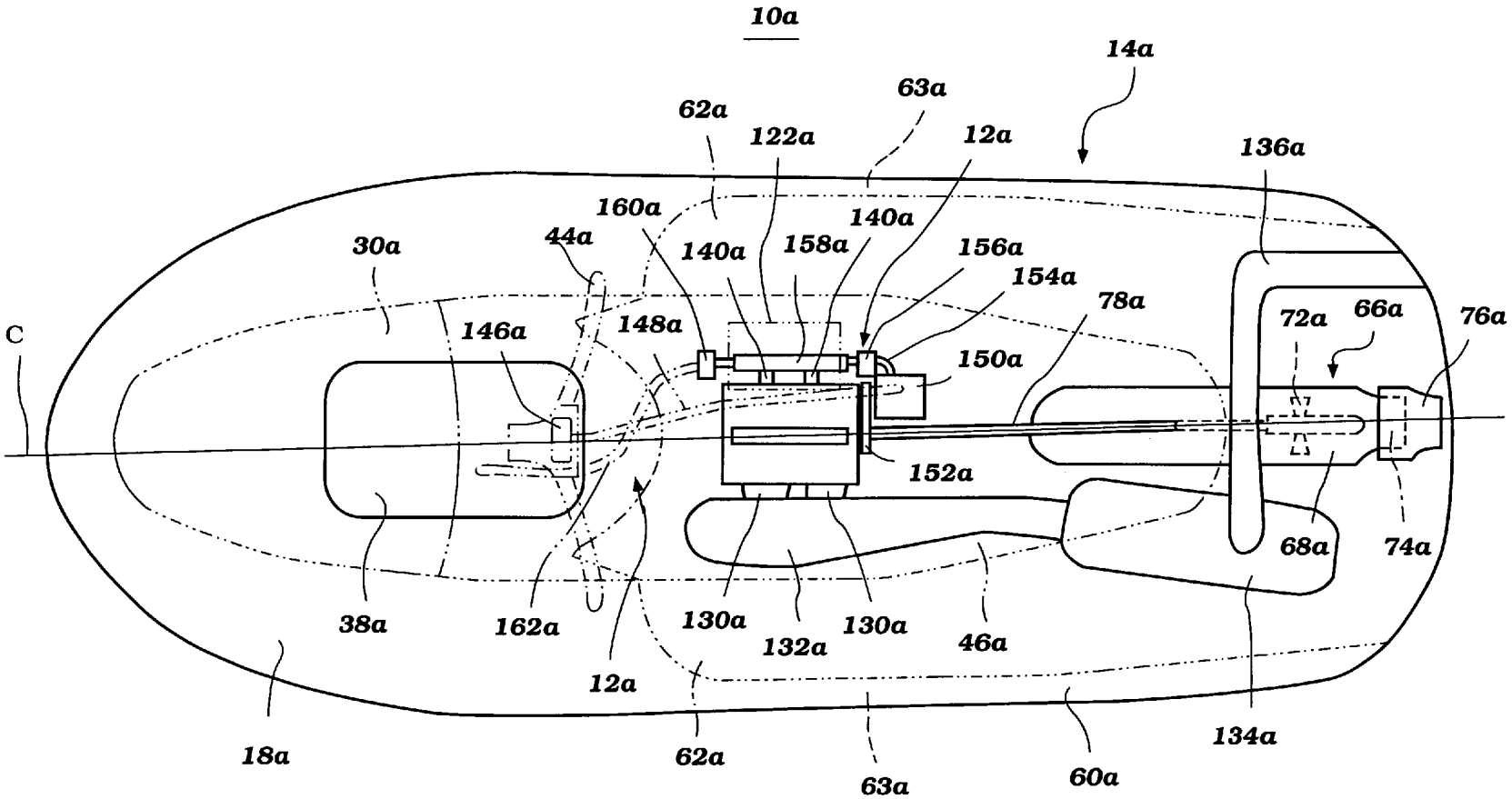
FIG. 5 is a top view of the fuel injection system and an engine of the watercraft of FIG. 4 with the body of the watercraft illustrated in phantom.
Figure 6:
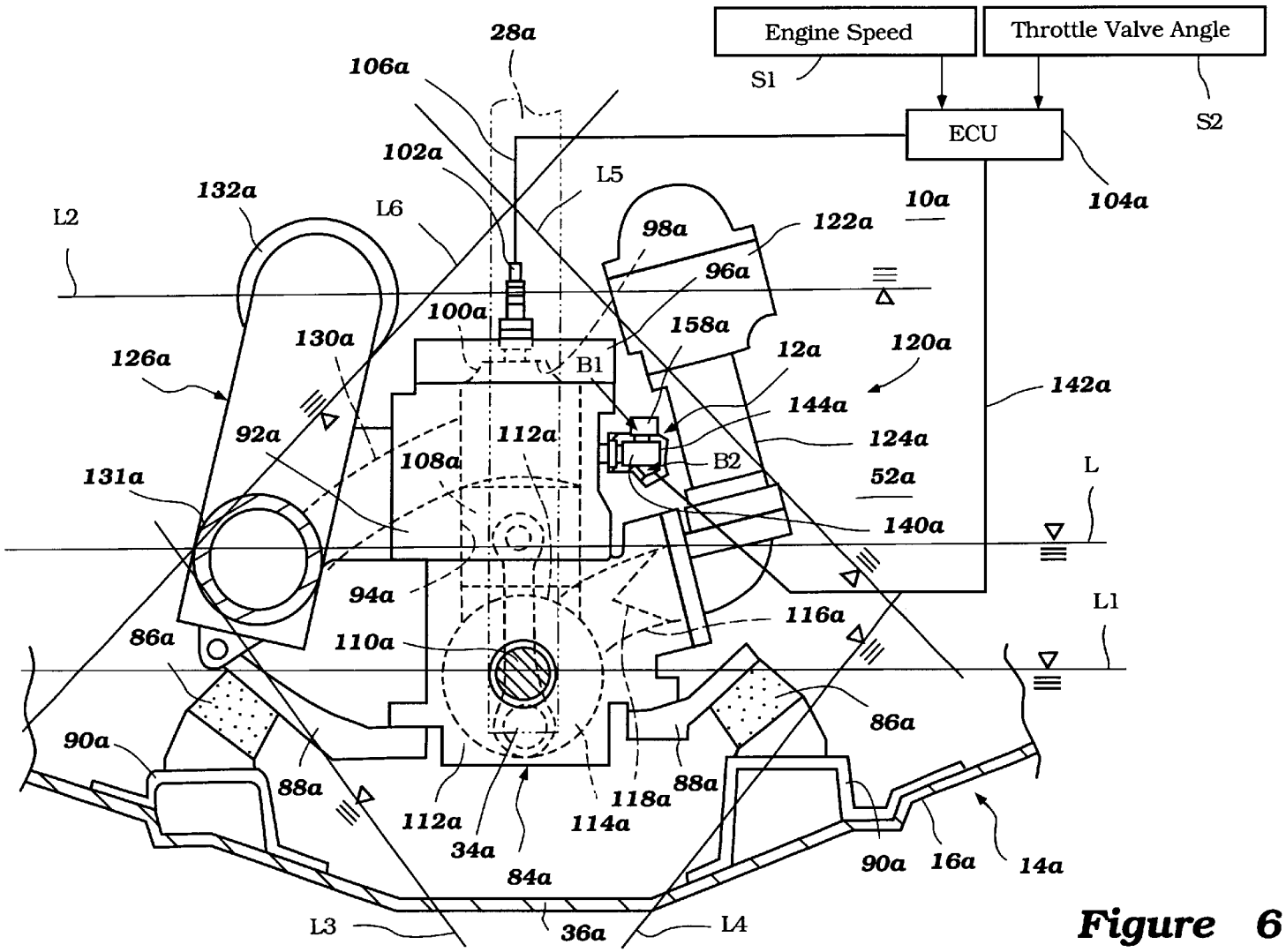
FIG. 6 is a cross-sectional view of the watercraft of FIG. 1 taken along line VI—VI.

FIGS. 4–6 illustrate another embodiment of the present fuel injection system. With the exception of the position of the fuel injectors on the cylinder block, the balance of the components of the fuel injection system, as well as the watercraft, are identical to those of the above-described embodiment. For this reason, like components have been identified with similar reference numerals with an "a" suffix, with an understanding that the above description should apply equally to the components of the present embodiment unless indicated otherwise.

As best seen in FIG. 6, each fuel injector **140*a* is located in the space between the cylinder block 92*a* and the induction system 120***a*. In particular, each fuel injector 140*a* lies generally beneath the air intake box 122*a* in the space between the throttle body 124*a* and the side of the cylinder block 92*a*. The fuel rail 158*a* also extends within this area, lying generally beneath the intake box 122*a*, as best seen in FIG. 5.

In this position, each fuel injector 140*a* is positioned to inject fuel into the variable volume chamber at a position on the side of the cylinder block 92*a*. That is, each fuel injector 140*a* is mounted to the side of the cylinder block 92*a*. In the illustrated embodiment, the spray axis of the fuel injector 140*a* is generally normal to the axis of the cylinder bore 94*a*; however, other orientations of the fuel injectors 140*a* are possible. The spray nozzle of each fuel injector 140*a* is either positioned to spray directly into the variable volume chamber formed between the corresponding portions of the cylinder bore 94*a*, the head of the piston 108*a*, and the recess 98*a* of the cylinder head 96*a*, or into a scavenge passage formed within the cylinder block 92*a*. As noted above, the scavenge passages extend between the corresponding crankcase chamber and the variable volume chamber. Under either of these approaches, a fuel/air charge is formed before the variable volume chamber reaches the minimum volume.

As seen in FIG. 6, the position of the fuel injectors 140*a* and the fuel rail 158*a* are positioned at a location so as to lie above the water surface level when the watercraft 10*a* floats in an upright position (L1), as well as when the watercraft 10*a* floats in an inverted position L2. More preferably, the position as shown lies above the water surface level (L) when the watercraft 10*a* floats upright with passengers loaded on the watercraft 10*a* and the engine compartment 52 contains water.

The exposed position of the fuel injectors 140*a* and the fuel rod 158*a* also desirably are positioned so as to lie above the water surface level regardless of the orientation of the watercraft. As seen in FIG. 6, these components and their sensitive connection points B1 and B2 will normally lie above the water surface level even when the watercraft is leaned on its port or starboard sides from an upright position (as illustrated by lines L3 and L4), and as well when leaned on its port or starboard sides from an inverted position (as schematically illustrated by lines L5 and L6 in FIG. 6).

The position of the fuel injectors 140*a* and the fuel rail 158*a* also lie above the bottom ends 34*a*, 58*a* of the air ducts 28*a*, 54*a* that introduce air into the engine compartment 52*a*. The fuel injectors 140*a* and the fuel rail 158*a*, as well as the sensitive connection points B1 and B2, also lie above the water pick-up 80*a* of the bilge system. With this arrangement, water is less likely to contact these components 140*a*, 158*a*, and the sensitive connection points B1 and B2. The waterproof cover 144*a* also shields the components and the sensitive connection points from water that may splash or slush or be sprayed within the engine compartment 52*a*.

Figure 7:
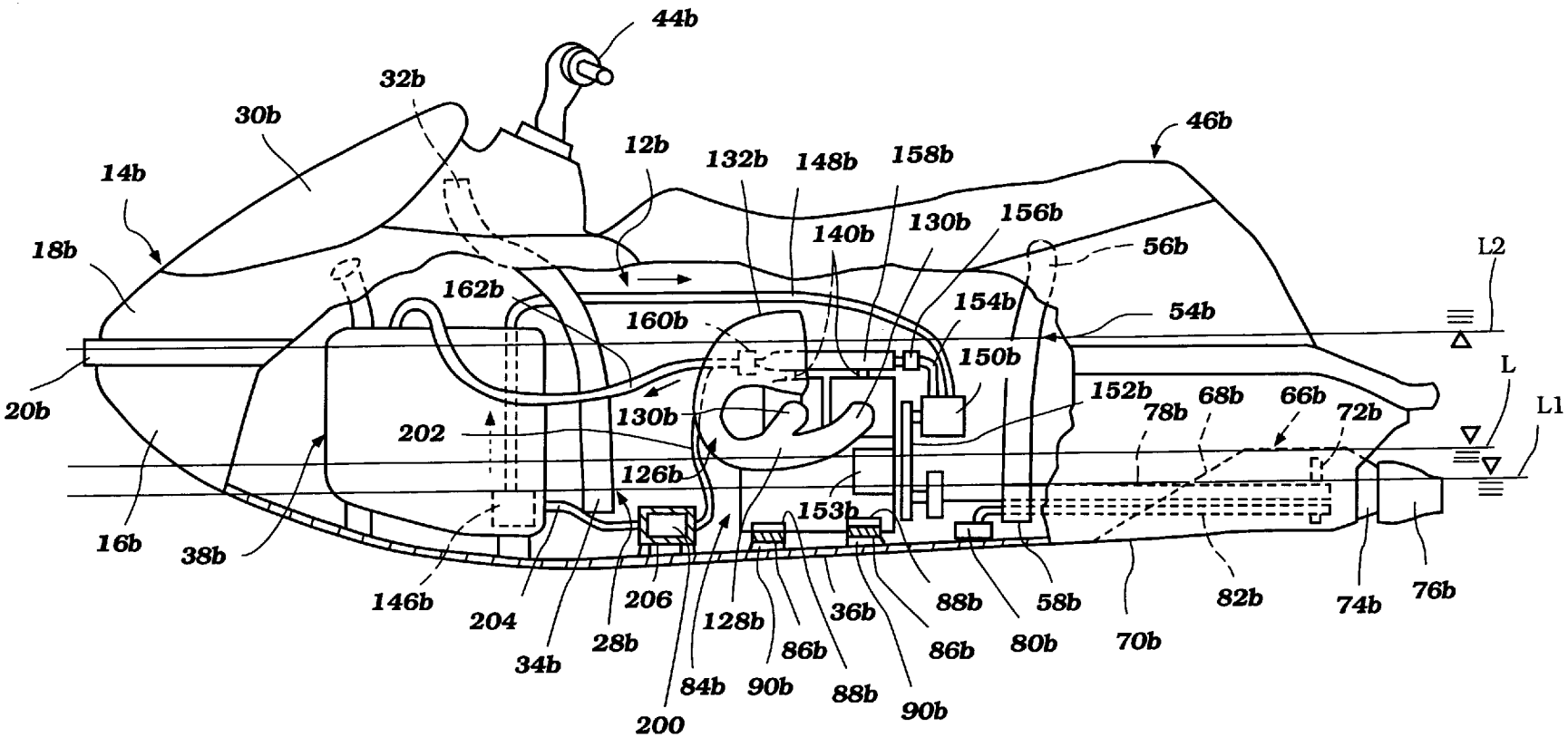
FIG. 7 is a partial sectional, side elevational view of a personal watercraft including a fuel injection system arranged within the watercraft in accordance with an additional preferred embodiment of the present invention.

FIG. 7 illustrates an additional embodiment of the present fuel injection system. This embodiment is substantially similar to the embodiment described in connection with FIGS. 1–3, save the fuel return side of the fuel injection system. Accordingly, like reference numerals with a "b" suffix have been used to indicate common components between these embodiments. The above description of these like components should apply equally to the present embodiment, unless instructed otherwise.

As seen in FIG. 7, the fuel supply system 12*b* includes a return pump 200 that is connected to the fuel return line 162*b* by an auxiliary fuel return line 202. The auxiliary fuel return line 202 branches from the fuel line 162*b* at a point downstream of the pressure regulator 160*b*.

The fuel pump 200 desirably is a mechanical pump driven by an electric motor which draws fuel from the fuel return line 162*b* through the auxiliary return line 202. The fuel pump 200 delivers fuel to the fuel tank 38*b* through a delivery line 204. As a result, the fuel is quickly returned from the fuel rail 158*b* to reduce the time of exposure of the fuel to the effect of heat radiating from the exhaust system 126*b*. As a result, heat admitted from the exhaust system 126*b* does not meaningfully elevate the temperature of the fuel.

In the illustrated embodiment, the fuel pump 200 is located on the lower wall 36*b* of the lower hull portion 16*b*. A protective casing 206 covers the pump 200 to protect the pump 200 from any water within the bilge area of the hull 14*b*. The electric motor of the pump 200 desirably is driven off of the power produced by the generator 153*b*. This pump can either be directly powered by the generator 153*b* or by a battery in the watercraft 10*b* which the generator 153*b* charges.

FIG. 8 illustrates another embodiment of the present fuel injection system. The illustrated embodiment is similar to those described above, except for the position of the fuel injectors. For this purpose, like reference numerals with a "c" suffix have been used to indicate similar components between the embodiments. The above description of like components should apply equally to the present embodiment, unless noted otherwise.

The engine 84*c* includes charge formers that are each formed by the corresponding throttle body 24*c* and fuel injector 140*c*. The fuel injector 140*c* is mounted to the side of the throttle body 24*c* at a location downstream of the throttle valve 300, as seen in FIG. 8. Thus, a fuel/air charge is formed within the induction system 120*c* and is delivered to the corresponding crankcase chamber 114*c* through the intake passage 116*c* and the reed valve 118*c*.

In the illustrated embodiment, the fuel injectors 140*c* and the fuel rail 158*c* are located on a side of the throttle bodies 124*c* opposite that of the cylinder block 92*c*. In this position, each electrical cable 142*c* connects to the corresponding fuel injector connector at point B2 on the outer side of the engine 84*c*. Likewise, the connection point B1 between the fuel injector 140*c* and the fuel rail 158*c* is also located on the outer side of the engine 84*c*. The protective covering 144*c* covers these components 140*c*, 158*c* and their respective connection points B1, B2. It is understood, however, that the fuel injectors 140*c* and the fuel rail 158*c* could be located in the space between the cylinder block 92*c* and the throttle bodies 124*c*, as illustrated in FIG. 6, but the fuel injectors 140 could still communicate with the throttle passages rather than directly with the cylinder bore 94*c*.

In this illustrated position, the fuel injectors 140*c* and fuel rail 158*c* lie at a point above the lower ends of the air ducts (not shown). These components 140*c*, 158*c* and their sensitive connection points B1, B2, also are positioned above the intake of the bilge system, similar to all of the above-described embodiments.

The position of the fuel injectors 140*c* and the fuel rod 158*c* also desirably lies above the water surface level when the watercraft 10*c* is upright, as well as the water surface level L2 when the watercraft 10*c* is inverted. More preferably, these components 140*c*, 158*c* and the connection points B1 and B2 lie above the water surface level L when the watercraft 10*c* is upright and at rest, with passengers seated thereon and water present within the bilge (i.e., in the bottom portion of the engine compartment).

As common to each of the above-described embodiments, the fuel injector and the fuel rail, and the sensitive connection points B1, B2, are located in a position within the engine compartment so as to prevent these components from being submerged should the watercraft become inverted or when the watercraft is fully loaded. In addition, a protective covering shields the sensitive connection points of these components from water that may be present in the engine compartment and slush around or be sprayed up during the operation of the watercraft. In a more preferred mode, the fuel injectors and the fuel rail, as well as the sensitive connection points B1, B2, are located within the engine compartment so as to protect these components from water regardless of the orientation of the watercraft when floating in the water. Thus, for instance, these components remain above the water surface level when the watercraft is turned on its port or starboard side, from an upright position, or when floating on its port starboard side when rotated from an inverted position. As a result, these components are less likely to be damaged by water to improve the reliability and durability of the fuel injection system.

Although this invention has been described in terms of certain preferred embodiments, other embodiments apparent to those of ordinary skill in the art are also within the scope of this invention. For instance, it will be apparent to one of ordinary skill in the art that various aspect and features of one of the above-described embodiments may be combined with another. Accordingly, the scope of the invention is intended to be defined only by the claims that follow.

What is claimed is:

1. A watercraft comprising a hull defining an engine compartment, at least one air duct communicating with the engine compartment through an outlet end, an internal combustion engine positioned within the engine compartment and having an output shaft, a propulsion device carried by the hull and driven by the output shaft of the engine to propel the watercraft, and a fuel supply system including at least one fuel injector communicating with the engine, and a fuel delivery conduit connected to the fuel injector, a connection point between the fuel injector and the fuel delivery conduit being arranged within the engine compartment so as to lie above the outlet end of the air duct, and above a water surface level of the body of water in which the watercraft is operated when the hull floats in an upright position and when the hull floats in an inverted position.

2. A watercraft as in claim 1, wherein the connection point is positioned within the engine compartment so as to lie above the water surface level with the hull floating on its side.

3. A watercraft as in claim 1, wherein the connection point is positioned within the engine compartment so as to lie above the water surface level with the hull floating in an intermediate position between an upright position and a position with the hull lying on its side.

4. A watercraft as in claim 1, wherein the connection point is positioned within the engine compartment so as to lie above the water surface level with the hull floating in an intermediate position between an inverted position and a position with the hull lying on its side.

5. A watercraft as in claim 4, wherein the connection point is positioned within the engine compartment so as to lie above the water surface level also when the hull floats on its side, and when the hull floats in an intermediate position between an upright position and a position with the hull lying on its side.

6. A watercraft as in claim 1, wherein the connection point is positioned within the engine compartment so as to lie above the water surface level of the body of water in which the watercraft is operated when the hull floats in an upright position and is loaded by at least one person.

7. A watercraft as in claim 1, wherein a water-proof cover encloses the connection point between the fuel injector and the fuel rail.

8. A watercraft as in claim 1 additionally comprising a bilge system including a water pick-up device, and the connection point is arranged within the engine compartment above the water pick-up device.

9. A watercraft as in claim 1 additionally comprising another air duct arranged to communicate with the engine compartment through an opening, and the connection point is located at a level within the engine compartment above the opening.

10. A watercraft comprising a hull defining an engine compartment, at least one air duct communicating with the engine compartment through an outlet end, an internal combustion engine positioned within the engine compartment and having an output shaft, a propulsion device carried by the hull and driven by the output shaft of the engine to propel the watercraft, and a fuel supply system including at least one fuel injector communicating with the engine, the fuel injector having an electrically controlled valve connected to an electrical connector, and an electrical cable connected to the electrical connector to provide a control signal to the valve, a connection point between the fuel injector electrical connector and the electrical cable being arranged within the engine compartment so as to lie above the outlet end of the air duct, and above a water surface level of the body of water in which the watercraft is operated when the hull floats in an upright position and when the hull floats in an inverted position.

11. A watercraft as in claim 10, wherein the connection point is positioned within the engine compartment so as to lie above the water surface level with the hull floating on its side.

12. A watercraft as in claim 10, wherein the connection point is positioned within the engine compartment so as to lie above the water surface level with the hull floating in an intermediate position between an upright position and a position with the hull lying on its side.

13. A watercraft as in claim 10, wherein the connection point is positioned within the engine compartment so as to lie above the water surface level with the hull floating in an intermediate position between an inverted position and a position with the hull lying on its side.

14. A watercraft as in claim 10, wherein the connection point is positioned within the engine compartment so as to lie above the water surface level also when the hull floats on its side, and when the hull floats in an intermediate position between an upright position and a position with the hull lying on its side.

15. A watercraft as in claim 10, wherein the connection point is positioned within the engine compartment so as to be above the water surface level of the body of water in which the watercraft is operated when the hull floats in an upright position and is loaded by at least one person.

16. A watercraft as in claim 10, wherein a water-proof cover encloses the connection point between the fuel injector electrical connector and the electrical cable.

17. A watercraft as in claim 10 additionally comprising a bilge system including a water pick-up device, and the connection point is arranged within the engine compartment above the water pick-up device.

18. A watercraft comprising a hull defining an engine compartment, an internal combustion engine positioned within the engine compartment and having an output shaft, a propulsion device carried by the hull and driven by the output shaft of the engine to propel the watercraft, a fuel supply system including at least one fuel injector communicating with the engine, and means for positioning at least a portion of the fuel injector to lie above a water surface level of the watercraft with the hull floating in an upright position and with the hull floating in an inverted position.

19. A watercraft as in claim 18 additionally comprising a waterproof cover that encloses at least part of the fuel injector.

20. A watercraft as in claim 18 additionally comprising an air duct that communicates with the engine compartment through at least one opening, and the fuel injector is arranged within the engine compartment at a level above the opening of the air duct.

21. A watercraft as in claim 18 additionally comprising a bilge system including a water pick-up device, and the fuel injector is arranged within the engine compartment above the water pick-up device.

22. A watercraft comprising a hull defining an engine compartment, a plurality of floatation elements arranged within the hull, at least one air duct communicating with the engine compartment through an outlet end, an internal combustion engine positioned within the engine compartment and having an output shaft, a propulsion device carried by the hull and driven by the output shaft of the engine to propel the watercraft, and a fuel supply system including at least one fuel injector communicating with the engine, the fuel injector being arranged within the engine compartment so as to be above a water surface level of the body of water in which the watercraft is operated regardless of the orientation of the hull within the water.

23. A watercraft as in claim 1, wherein the engine includes at least one cylinder defined therein having a cylinder axis, the fuel injector arranged to inject fuel into the cylinder generally along the cylinder axis.

24. A watercraft as in claim 23, additionally comprising a sparkplug arranged offset from the cylinder axis.

25. A watercraft as in claim 6, wherein the connection point is positioned within the engine compartment so as to lie above the water surface level of the body of water in which the watercraft is operated when the hull floats in an upright position, is fully loaded with passengers and gear, and there is water present in the engine compartment of the watercraft.

26. A watercraft as in claim 1, wherein the connection point is positioned within the engine compartment so as to lie above the water surface level of the body of water in which the watercraft is operated when the hull floats in an upright position and an inverted position with no passengers and no water in the engine compartment.

27. A watercraft as in claim 26, wherein the connection point is positioned within the engine compartment so as to lie above the water surface level of the body of water in which the watercraft is operated when the hull floats in any orientation with no passengers and no water in the engine compartment.

28. A watercraft as in claim 10, wherein the engine includes at least one cylinder defined therein having a cylinder axis, the fuel injector arranged to inject fuel into the cylinder generally along the cylinder axis.

29. A watercraft as in claim 28, additionally comprising a sparkplug arranged offset from the cylinder axis.

30. A watercraft as in claim 15, wherein the connection point is positioned within the engine compartment so as to be above the water surface level of the body of water in which the watercraft is operated when the hull floats in an upright position, is fully loaded with passengers and gear, and there is water present in the engine compartment of the watercraft.

31. A watercraft as in claim 10, wherein the connection point is positioned within the engine compartment so as to be above the water surface level of the body of water in which the watercraft is operated when the hull floats in an upright position and an inverted position with no passengers and no water in the engine compartment.

32. A watercraft as in claim 31, wherein the connection point is positioned within the engine compartment so as to lie above the water surface level of the body of water in which the watercraft is operated when the hull floats in any orientation with no passengers and no water in the engine compartment.

33. A watercraft as in claim 18, wherein the engine includes at least one cylinder defined therein having a cylinder axis, the fuel injector arranged to inject fuel into the cylinder generally along the cylinder axis.

34. A watercraft as in claim 33 additionally comprising a sparkplug arranged offset from the cylinder axis.

35. A watercraft as in claim 18, wherein the means for positioning positions at least a portion of the fuel injector above the water surface level of the body of water in which the watercraft is operated when the hull floats in an upright position, is fully loaded with passengers and gear, and there is water present in the engine compartment of the watercraft.

36. A watercraft as in claim 18, wherein the means for positioning positions at least a portion of the fuel injector above the water surface level of the body of water in which the watercraft is operated when the hull floats upright or inverted with no passengers and no water present in the engine compartment.

37. A watercraft as in claim 36, wherein the means for positioning positions at least a portion of the fuel injector above the water surface level of the body of water in which the watercraft is operated when the hull floats in any orientation with no passengers and no water present in the engine compartment.

38. A watercraft as in claim 22, wherein the fuel injector lies above the water surface level of the body of water in which the watercraft is operated when the hull floats in an upright position, is fully loaded with passengers and gear, and there is water present in the engine compartment of the watercraft.

39. A watercraft as in claim 22, wherein the fuel injector lies above the water surface level of the body of water in which the watercraft is operated regardless of the orientation of the hull with no passengers and no water present in the engine compartment.

* * * * *